US005460153A

United States Patent [19]

Huntt

[11] Patent Number: 5,460,153

[45] Date of Patent: Oct. 24, 1995

[54] ARCHERY ARROW GUIDE

[76] Inventor: Robert L. Huntt, 10420 Watkins Rd., Germantown, Md. 20874

[21] Appl. No.: 278,202

[22] Filed: Jul. 21, 1994

[51] Int. Cl.[6] ..... F41B 5/22

[52] U.S. Cl. ..... 124/445; 124/86; 124/24.1

[58] Field of Search ..... 124/44.5, 24.1, 124/86, 22, 23.1, 41.1, 26

[56] References Cited

U.S. PATENT DOCUMENTS

| | | | |
|---|---|---|---|
| 213,083 | 3/1879 | Wright et al. | 124/24.1 |
| 4,282,850 | 8/1981 | Warnicke | 124/24.1 |
| 4,372,282 | 1/1983 | Sanders | 124/24.1 |
| 4,759,337 | 7/1988 | Suski | 124/24.1 |
| 4,858,589 | 8/1989 | Chang | 124/24.1 |
| 4,917,072 | 4/1990 | Chang | 124/41.1 |
| 5,042,450 | 8/1991 | Jacobson | 124/44.5 |
| 5,253,663 | 10/1993 | Sisko | 124/44.5 |

OTHER PUBLICATIONS

*Bowhunting World,* Aug. 1990, p. 11, advertisement: "Freddie's Original Golden Key Arrow Rests".

*Primary Examiner*—Anthony Knight

*Attorney, Agent, or Firm*—Lowe, Price, LeBlanc & Becker

[57] ABSTRACT

An arrow adapted to be mounted on an archery bow comprises a unitary elastomeric diaphragm having: a clamped periphery, a central opening for receiving an arrow shaft and plural openings through which vanes of the arrow are projected as the arrow is released from the box. The slots intersect and radiate from the opening. The diaphragm is arranged so (a) the arrow shaft is substantially surrounded by and is in contact with interior surfaces of the diaphragm when the arrow is nocked and (b) the interior contacting surfaces as well as diaphragm portions surrounding them move in the direction of arrow flight as the arrow is released. A metal stiffening ring for the clamped diaphragm periphery prevents movement of a peripheral unclamped portion of the diaphragm between the clamped periphery and the portions of the diaphragm which move as the arrow is released.

11 Claims, 3 Drawing Sheets

ARCHERY ARROW GUIDE

FIELD OF INVENTION

The present invention relates generally to archery arrow guides and more particularly to an archery arrow guide having a unitary elastomeric diaphragm with a clamped periphery, a central opening for receiving an arrow shaft and a diaphragm stiffening member for preventing movement of a peripheral unclamped portion of the diaphragm between the clamped periphery and portions of the diaphragm which move as the arrow is projected.

BACKGROUND ART

Archery arrow guides and holders are known in the art. One such device is disclosed in Warnicke, U.S. Pat. No. 4,282,850 as including a one piece elastomeric diaphragm permanently clamped in place on a bow. The diaphragm has a peripheral portion fixedly secured, apparently by some type of adhesive, to a flange of a central opening of the bow. The diaphragm includes a central opening for receiving a shaft of the arrow and three fins extending outwardly from the central opening to the diaphragm peripheral portion. Between the fins are relatively large, almost circular openings for receiving vanes or fins on the arrow shaft. After the arrow has been nocked and the bow has been drawn and as the arrow is released, interior portions of the diaphragm contacting the arrow shaft move forward as the arrow is projected forwardly.

In working on an archery arrow guide somewhat similar to the guide disclosed by Warnicke, I found sufficient stability is not provided by such an elastomeric structure to enable the desired guiding effect to be achieved. I found the elastomeric material had a tendency to rotate in a plane at right angles to movement of the arrow shaft as the arrow is projected forwardly. If a stiffer material not having such a tendency is employed, the portion of the diaphragm contacting and adjacent the arrow shaft is excessively stiff and does not move adequately with the forwardly projected arrow.

The Warnicke device is not adapted to be used with currently existing bows because the diaphragm is permanently attached to a specially manufactured bow. Because the Warnicke guide is not used with existing, conventional bows, the Warnicke approach is excessively expensive.

In addition, elastomeric diaphragms have a tendency to wear after prolonged use. Wearing occurs because of the tendency for the central opening to change size and shape after many uses. With the Warnicke device, a worn diaphragm should be removed and another diaphragm should be secured in situ on the bow, apparently by using an appropriate adhesive or the like. Removal of the diaphragm can be difficult and damage the bow.

Because the Warnicke guide has a diaphragm adhesively mounted on the bow, arrows having shafts with different diameters are not optimally used with this prior art guide. The constant diameter central opening does not optimally handle differing arrow shaft diameters. For arrow shaft diameters larger than the central opening diameter, relatively large frictional forces are imparted by tips of the vanes to the arrow shaft. While this may provide somewhat improved guiding of an arrow, the large frictional force would appear to substantially reduce the distance the arrow can travel.

An additional problem with the guide disclosed by Warnicke is that the plane of the diaphragm is fixed relative to the bow string. This has the disadvantage of preventing pressure adjustments on the arrow as the bow is being drawn and the arrow is being released.

A further disadvantage of the Warnicke structure is the relatively large size of the almost circular openings. Because of the large area of these openings relative to the arrow vane or fin cross section, no control is provided by the guide for the vanes.

It is, accordingly, an object of the present invention to provide a new and improved archery arrow guide having a unitary elastomeric diaphragm, arranged to have an improved guiding function relative to the prior art as a result of greater diaphragm stability.

Another object of the invention is to provide a new and improved archery arrow guide including a unitary elastomeric diaphragm having a central opening with interior parts for engaging the arrow shaft, which diaphragm has a tendency to remain stabilized in planes at right angles to the direction of arrow movement.

An additional object of the present invention is to provide a new and improved archery arrow guide including a holder mounted unitary elastomeric diaphragm adapted to be used with conventional existing bows.

An additional object of the present invention is to provide a new and improved archery arrow guide including a holder mounted unitary elastomeric diaphragm arranged to be easily changed as the diaphragm wears or if arrows having differing shaft diameters are employed.

An additional object of the present invention is to provide a new and improved arrow guide including a unitary elastomeric diaphragm arranged so the plane of the diaphragm can be moved relative to the bow string, to thereby control the pressure on the arrow as the bow is being drawn and as the arrow is being released.

THE INVENTION

In accordance with the present invention, a guide for an arrow including a shaft and plural vanes comprises a unitary elastomeric diaphragm having a clamped periphery, a central opening for receiving the shaft and plural openings through which the vanes are projected as the arrow is released from the bow after the bow has been drawn. The slots intersect and radiate from the opening. The diaphragm is arranged so the arrow shaft is substantially surrounded by and is in contact with interior surfaces of the diaphragm when the arrow is nocked. The interior contacting surfaces, as well as diaphragm portions surrounding them, move in the direction of arrow flight as the arrow is released. A stiffening member for the clamped diaphragm periphery prevents movement of a peripheral unclamped portion of the diaphragm between the clamped periphery and the portions of the diaphragm which move as the arrow is released. I found such a stiffening member to overcome the tendency of the elastomeric material to rotate in a plane at right angles to movement of the arrow shaft as the arrow is projected forwardly. The stiffener member does not interfere with movement of the portion of the elastomeric diaphragm contacting the arrow shaft. Hence excellent arrow guiding is achieved through the use of such a stiffening member.

In a preferred embodiment, the stiffening member is buried in the diaphragm periphery and extends into a peripheral unclamped portion of the diaphragm. The stiffening member is removed from diaphragm portions which move as the arrow is released so it does not materially impede the arrow velocity.

A feature of the invention is that the openings are configured as elongated slots each having a width only slightly greater than the thickness of the arrow vanes. The slots are angularly displaced from each other by the same angle as the angular displacement of the vanes. This arrangement helps to stabilize the vanes as the arrow is initially projected and enhances the guiding function of the device.

Another feature is that the diaphragm periphery is preferably clamped between an end face of a tube and a flange on a cap mating with and selectively secured to the tube. This particular construction facilitates removal and insertion of the diaphragm. To achieve this function, the tube preferably has an exterior threaded side wall and the cap is mated with and secured to the tube by threads on the cap interior side wall that engage the tube exterior side wall threads.

A further feature is that the plane of the diaphragm relative to a bow string is controlled at will. This function is preferably provided by pivotally mounting a holder for the diaphragm on a side wall of the bow so that as the plane of the diaphragm changes relative to the bow string the pressure on the arrow as the bow is being drawn and as the arrow is released is accordingly varied.

The above and still further objects, features and advantages of the present invention will become apparent upon consideration of the following detailed description of a specific embodiment thereof, especially when taken in conjunction with the accompanying drawings.

BEST MODE FOR CARRYING OUT THE INVENTION

Figure 1:
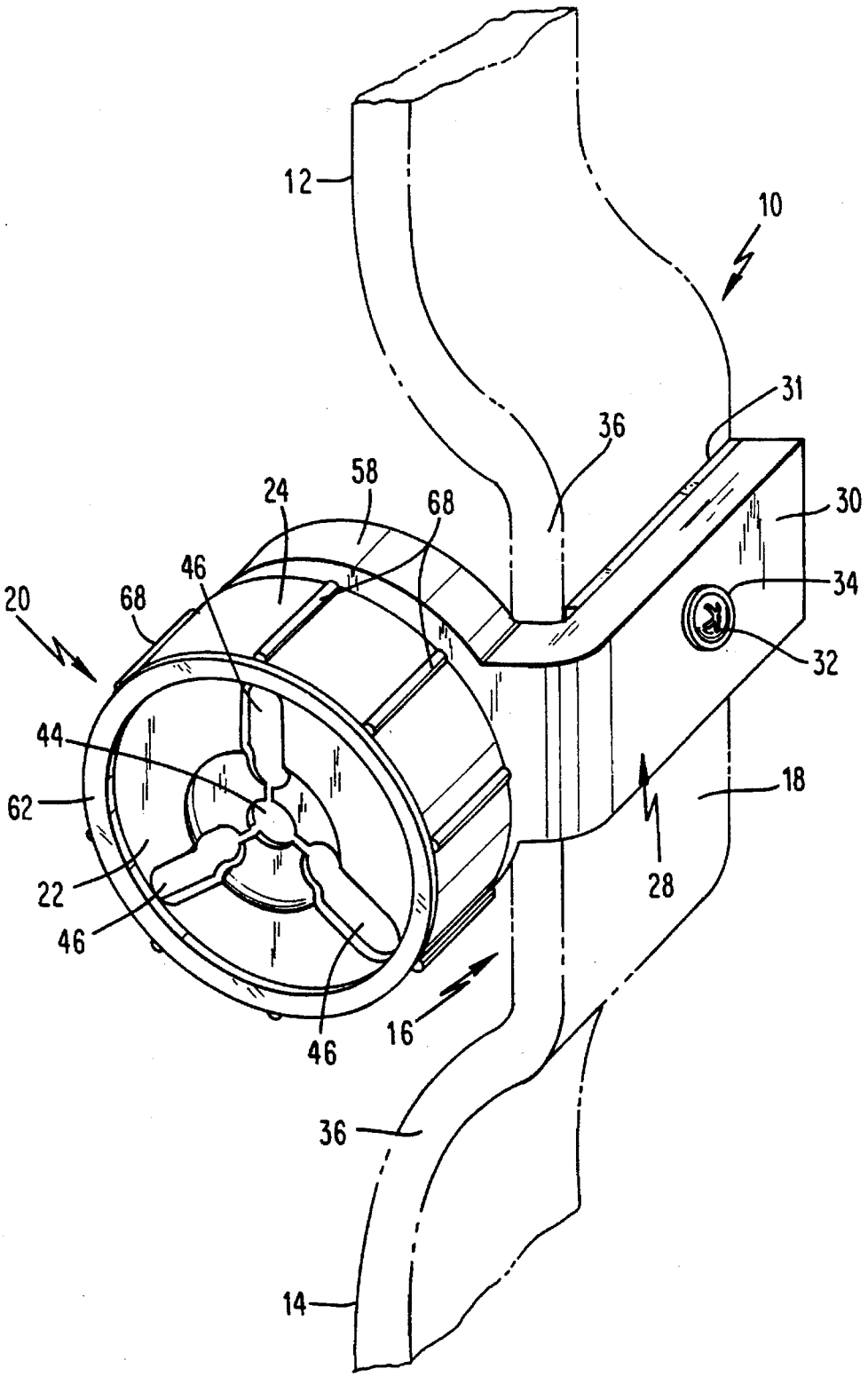
FIG. 1 is a partial perspective view of a bow equipped with an arrow guide and holder in accordance with a preferred embodiment of the present invention.

Reference is now made to FIG. 1 of the drawing, a perspective view of a portion of a riser 10 of a conventional composite modern bow including arched indentation 16 having a sidewall 18 on which is located a threaded bore (not shown). Normally, an arrow rest is fixedly secured to indentation 16 by a bolt that fits through an aperture on the arrow rest; the bolt is threaded into the bore on sidewall 18.

In accordance with the present invention, the arrow rest of a conventional bow is replaced with arrow guide 20 that is mounted on riser 10 in the threaded bore on sidewall 18. Arrow guide 20 includes unitary diaphragm or membrane 22, cup 24, cylinder 26 and holder 28. Holder 28 includes an elongated arm 30 extending between front and rear edges of sidewall 18 and abutting against shim 31, sandwiched between the sidewall and a corresponding interior wall of holder 28, so the center of diaphragm 22 is aligned with the bow string.

Holder 28 includes a bore having approximately the same diameter as the threaded bore on sidewall 18 and aligned therewith when guide 20 is in situ. Bolt 32 presses washer 34 against the outer wall of holder 28 and extends through aligned apertures in the holder and shim 31 into the threaded bore in sidewall 18, to hold guide 20 firmly in place. This assembly enables guide 20 to be pivoted about the axis of bolt 32 so the plane of diaphragm 22 can be varied relative to the plane of front face 36 of brace 10 to adjust the pressure on a drawn, nocked arrow.

Reference is now made to FIGS. 2–5 wherein details of guide 20 are illustrated. Diaphragm 22 is a unitary member formed of flexible, elastomeric disc 41 and stiffening member 42. Disc 41 has sufficient stiffness to accurately guide an arrow including shaft 38 and three vanes 40, equispaced from each other in a conventional manner. In a preferred embodiment, disc 41 is formed of molded polyurethane having a durometer of 60. A radially extending slit (not shown) formed around the periphery of disc 41 carries stiffening member 42, in the form of a spring steel ring; in a preferred embodiment the ring has a thickness of 0.010 inches. Ring shaped stiffening member 41 includes indentations 64 around the outer portions of slots 46. Stiffening member 42 is bonded to disc 41 by an appropriate bonding agent to form the unitary diaphragm or membrane 22. Disc 41 includes very small diameter holes 66 for injecting a bonding agent between the radially extending slit in the disc and stiffening member 42 to hold the stiffening member in place in the disc.

Stiffening member 42 enables the unitary membrane structure to provide the desired guiding effect for the arrow including shaft 38 and vanes 40. Stiffening member 42 overcomes the tendency of the elastomeric material of disc 41 to rotate in a plane at right angles to the movement of arrow shaft 38 as the arrow shaft is projected forwardly. By burying steel stiffener ring member 42 in polyurethane disc 41 having a durometer of 60, the portion of the polyurethane disc containing arrow shaft 38 is quite resilient and does not have a material adverse effect on the speed of the arrow. To provide the desired stiffening effect, stiffener member 42 extends radially toward the center of disc 41 beyond the clamped peripheral portion of the disc.

Disc 41 includes central opening 44, having a diameter slightly less than the diameter of arrow shaft 38, so there is contact between the entire inner diameter of disc 41 and the entire periphery of arrow shaft 38 to provide the desired guiding effect. The diameters of opening 44 and arrow shaft 38 are such that the elastomeric material of disc 41 at the periphery of opening 44 exerts a slight frictional, guiding force on the arrow shaft as the arrow moves forward after being drawn.

Extending from central opening 44 are three radially extending slots 46, spaced from each other by 120°. Each 15 of slots 46 includes a narrow portion 48 intersecting opening 44 and a wider section 50, extending between narrow portion 48 almost to the periphery of disc 41. When the arrow is nocked and in guide 20, vanes 40 are aligned with slots 46. Narrow portions 48 of slots 46 are only slightly wider than the thicknesses of vanes 40, while enlarged portions 50 of the slots are considerably wider than the thicknesses of the vanes. This arrangement helps to provide stability to the projected arrows.

Figure 4:
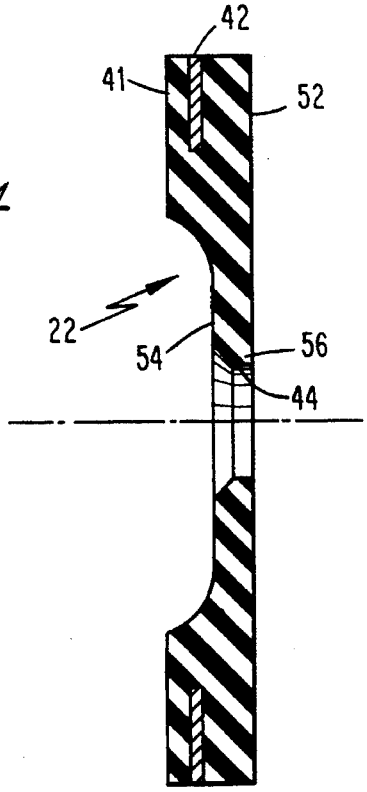
FIG. 4 is a side sectional view of the diaphragm illustrated in FIG. 3, taken through the lines 4—4.
Figure 5:
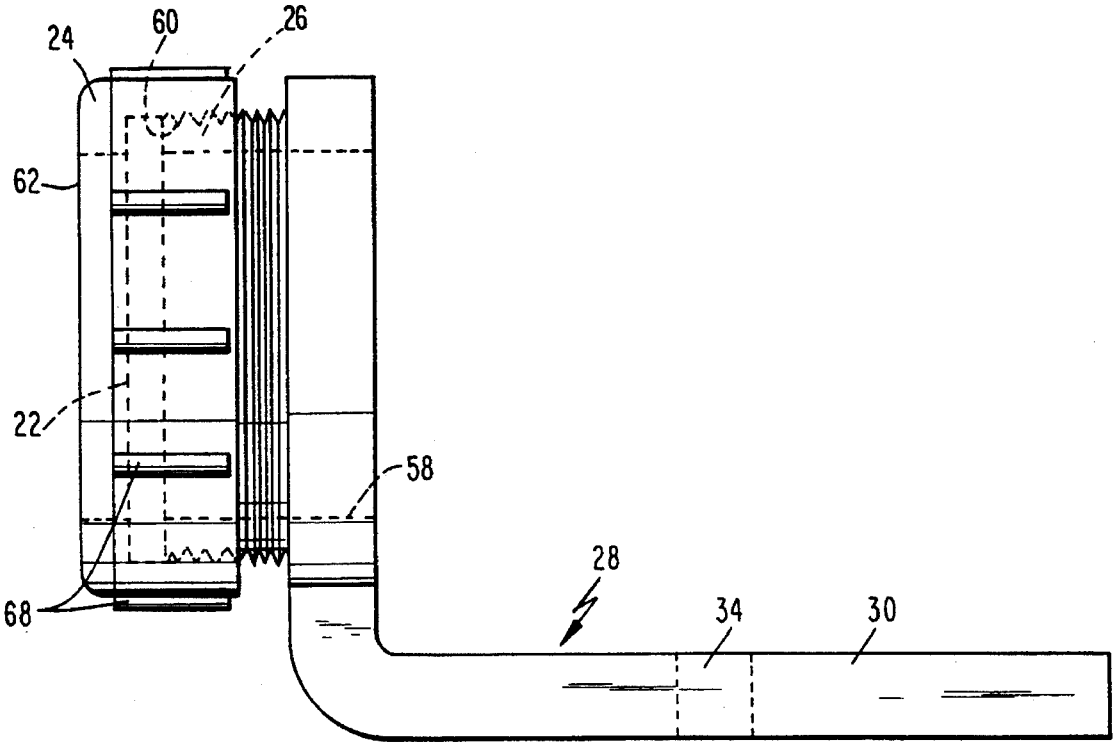
FIG. 5 is a top view of the guide and holder illustrated in FIG. 1.

As illustrated in FIG. 4, disc 41 has a thickness considerably in excess of the thickness of stiffener member 42 in the portion of the disc in which the stiffener member is located; in a preferred embodiment, disc 41 has a thickness of approximately 0.2 inches in the peripheral region of the disc where stiffener member 42 is located. Back face 52 of disc 41 is relatively flat, while the front face of the disc is tapered inwardly to form collar 54, having a further taper at its inner peripheral portion to form neck 56. The inner wall of neck 56 forms the periphery or boundary of opening 44. Collar 54 is thereby somewhat flexible while neck 56 is quite flexible and moves easily as arrow shaft 38 moves through opening 44 in contact with the inner peripheral wall of the neck. In a preferred embodiment, the wall of neck 56 has a thickness of approximately 0.02 inches.

Diaphragm 22 is held in situ on holder 28 by an arrangement including cylinder 26, mounted on ring 58 of holder 28 and cup 24. Cylinder 26 includes a threaded exterior wall 60 onto which is screwed the threaded interior wall of cup 24. Cup 24 and cylinder 26 include central interior openings, having diameters slightly less than the diameter of disc 41. Cup 24 includes flange 62, having an inner diameter aligned with the inner diameter of cylinder 26.

Figure 2:
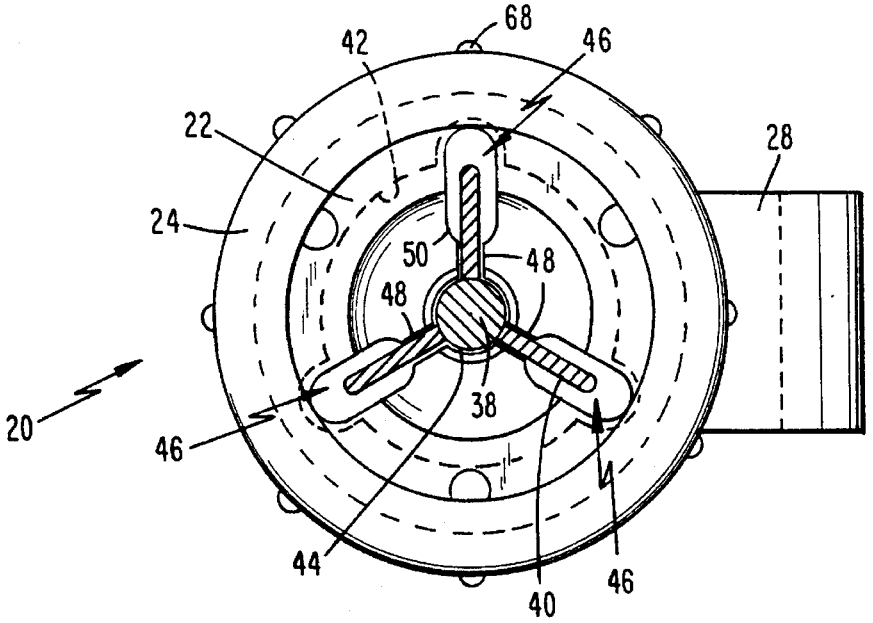
FIG. 2 is a front view of the guide and holder illustrated in FIG. 1.
Figure 3:
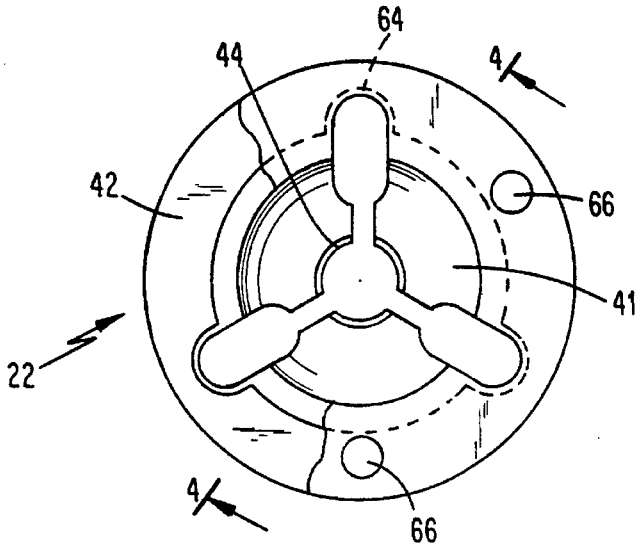
FIG. 3 is a front view, partly broken away, of a unitary elastomeric diaphragm employed in the guide illustrated in FIGS. 1 and 2.

Disc 41 is clamped in place between flange 62 and 15 the face of cylinder 26 remote from ring 58 by the frictional force exerted by the opposing faces of the flange and cylinder, resulting from cup 24 being screwed onto cylinder 26. As illustrated in FIG. 2, the exterior portions of slots 46 extend almost to the inside diameter of flange 62. In contrast, stiffener member 42 extends toward central opening 44 beyond the inside diameter of flange 62 and cylinder 26. The peripheral portion of diaphragm 22 is thereby clamped between flange 62 and the wall of cylinder 26 remote from ring 58. This provides a certain amount of stiffness to disc 41. Additional stiffening is provided by member 42 extending about one-third of the way from the inner diameters of flange 62 and cylinder 26 toward the center of opening 44. The additional stiffening provided by stiffening member 42 provides the enhanced stability attained by diaphragm 22, as discussed supra.

The threaded, screw-on relationship between cup 24 and cylinder 26 enables different diaphragms to be loaded into guide 20. To facilitate turning and tightening of cup 24 on cylinder 26, the cup is provided with longitudinally extending knurled projections 68 which are easily grasped by the archer to remove the cup from the cylinder and insert different diaphragms 22. It is desirable to insert different diaphragms to provide maximum efficiency in the event that arrows having different shaft diameters are employed; in such an instance, diaphragms having central openings 44 with different diameters, slightly less than the diameter of the arrow shaft, can be used. In addition, as a particular diaphragm wears and is no longer as effective as desired, the worn or spent diaphragm can be removed and replaced by a new diaphragm.

While there has been described and illustrated one specific embodiment of the invention, it will be clear that variations in the details of the embodiment specifically illustrated and described may be made without departing from the true spirit and scope of the invention as defined in the appended claims.

I claim:

1. A guide for an arrow including a shaft and plural vanes, the guide being mounted on or adapted to be mounted on an archery bow, the guide comprising a unitary elastomeric diaphragm having: a clamped periphery, a central opening for receiving the shaft and plural openings through which the vanes are projected as the arrow is released from the bow after the bow has been drawn, the slots intersecting and radiating from the opening, the diaphragm being arranged so (a) the arrow shaft is substantially surrounded by and is in contact with interior surfaces of the diaphragm when the arrow is nocked and (b) the interior contacting surfaces as well as diaphragm portions surrounding them move in the direction of arrow flight as the arrow is released, and a stiffening member for the clamped diaphragm periphery for preventing movement of a peripheral unclamped portion of the diaphragm between the clamped periphery and the portions of the diaphragm which move as the arrow is released.

2. The guide of claim 1 wherein the stiffening member is buried in the diaphragm periphery and extends to peripheral unclamped diaphragm portions.

3. The guide of claim 2 wherein the stiffening member is buried in the diaphragm periphery so the stiffening member is removed from the portions of the diaphragm which move as the arrow is released.

4. The guide of claim 3 wherein the diaphragm has a collar between the stiffening member and the opening, the collar having a thickness substantially less than the diaphragm portion where the stiffening member is buried.

5. The guide of claim 4 wherein the diaphragm has a neck between the collar and the opening, the neck having a thickness substantially less than the collar.

6. The guide of claim 1 wherein the openings are configured as elongated slots each having a width only slightly greater than the thickness of the arrow vanes and angularly displaced from each other by the same angle as the angular displacement of the vanes.

7. The guide of claim 1 wherein the diaphragm periphery is clamped between an end face of a tube and a flange on a cap mating with and selectively secured to the tube.

8. The guide of claim 7 wherein the tube is on a holder for mounting on a side wall of the bow to control the plane of the diaphragm relative to a bow string on the bow so that as the plane of the diaphragm changes relative to the bow string the pressure on the arrow as the bow is being drawn and as the arrow is released is accordingly varied.

9. The guide of claim 1 further including means for at will controlling the plane of the diaphragm relative to a bow string on the bow.

10. The guide of claim 1 wherein the diaphragm periphery is clamped between an end face of a tube having an exterior threaded side wall and a flange on a cap mating with and selectively secured to the tube, the cap being mated with and secured to the tube by threads on an interior side wall for engaging the threads of the tube exterior side wall.

11. The guide of claim 10 wherein the cap includes an exterior wall with manual gripping means for facilitating rotation of the cap relative to the tube.

* * * * *